US011772378B2

(12) United States Patent
Omura et al.

(10) Patent No.: US 11,772,378 B2
(45) Date of Patent: Oct. 3, 2023

(54) PRINTING ELEMENT AND METHOD FOR MANUFACTURING SAME

(71) Applicant: CANON KABUSHIKI KAISHA, Tokyo (JP)

(72) Inventors: Atsushi Omura, Kanagawa (JP); Yuji Tamaru, Tokyo (JP); Yosuke Takagi, Kanagawa (JP); Ryo Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 17/339,590

(22) Filed: Jun. 4, 2021

(65) Prior Publication Data

US 2021/0387454 A1 Dec. 16, 2021

(30) Foreign Application Priority Data

Jun. 12, 2020 (JP) ..... 2020-102356

(51) Int. Cl.
*B41J 2/14* (2006.01)
*B41J 2/16* (2006.01)

(52) U.S. Cl.
CPC ..... *B41J 2/14016* (2013.01); *B41J 2/1601* (2013.01); *B41J 2/1637* (2013.01)

(58) Field of Classification Search
CPC ..... B41J 2/14016; B41J 2/1601; B41J 2/1637
See application file for complete search history.

(56) References Cited

U.S. PATENT DOCUMENTS

| | | | | |
|---|---|---|---|---|
| 6,264,309 | B1 | 7/2001 | Sullivan | |
| 9,193,160 | B1 | 11/2015 | Hamada et al. | |
| 2018/0326723 | A1 | 11/2018 | Manabe et al. | |
| 2019/0217619 | A1 * | 7/2019 | Takeuchi | B41J 2/161 |

FOREIGN PATENT DOCUMENTS

JP 2012-051235 A 3/2012

* cited by examiner

*Primary Examiner* — Thinh H Nguyen
(74) *Attorney, Agent, or Firm* — Venable LLP

(57) ABSTRACT

A printing element includes a substrate, an intermediate layer, and a channel forming member layered in this order. The substrate has a common liquid chamber. The channel forming member has a second surface that is a surface facing the substrate via the intermediate layer, and a first surface that is an opposite surface to the second surface. The first surface is formed with a plurality of ejection ports that eject liquid from the common liquid chamber. The second surface is formed with a plurality of channels that allow each of the plurality of ejection ports and the common liquid chamber to communicate with each other, and a plurality of substantially parallel beam structures, the plurality of beam structures forming a slit portion therebetween.

6 Claims, 9 Drawing Sheets

PRINTING ELEMENT AND METHOD FOR MANUFACTURING SAME

BACKGROUND OF THE INVENTION

Field of the Invention

The present invention relates to a printing element and a method for manufacturing the same.

Description of the Related Art

A liquid ejection head that ejects liquid from nozzles is used conventionally in a liquid printing apparatus that ejects liquid, such as ink, for printing on recording media. There are various causes that bring about printing failures (hereinafter referred to as "detachment failure") during the use of such a liquid ejection head. For example, a printing failure may occur due to detachment of a member that forms bubbling chambers and liquid chamber (hereinafter referred to as "channel forming member") from a substrate member, or an ejection failure may occur when bubbling chambers are blocked by contamination particles during the manufacture or burrs dropping off from channel parts during the use.

Various measures taken for preventing ejection failures of the liquid ejection head are also known. In relation to detachment failure, for example, Patent Literature 1 (Japanese Patent Application Laid-open No. 2012-051235) proposes formation of an intermediate layer between a liquid chamber forming member and a substrate member to increase the bond, and provision of beam structures in a channel forming member, along with a slit additionally provided for stress dispersion. Such a slit can be readily provided according to Patent Literature 1.

With regard to printing failure caused by clogging by contamination particles, Patent Literature 2 (U.S. Pat. No. 6,264,309) provides a structure (hereinafter referred to as "intermediate layer filter") for collecting foreign substances by using the intermediate layer mentioned above. In the case where contamination particles are to be collected using the intermediate layer filter, the thinner the intermediate layer, the more the resistance to the liquid flow can be reduced. The intermediate layer itself can also serve as a countermeasure against detachment failure. The structure according to Patent Literature 2 offers the benefits of a simple manufacturing method and controllability of the structure during the manufacturing process through changes made to the intermediate layer pattern.

SUMMARY OF THE INVENTION

However, in the case where an intermediate layer filter is used, while a thinner filter can reduce resistance to the liquid as mentioned above, there is the risk that thickness reduction may lower the strength. Moreover, it has been found that, in the case where an intermediate layer filter is adopted in the structure where a slit is provided to beams of a channel forming member, the intermediate layer filter may cause adverse effects during the manufacture depending on its shape.

The present invention has been made in view of the issues described above, and an object thereof is to provide a technique for avoiding issues during the manufacture and suppressing a reduction in the strength of an intermediate layer used for a printing element of a liquid printing apparatus.

The present invention provides a printing element comprising a substrate, an intermediate layer, and a channel forming member, layered in this order, the substrate including a common liquid chamber, the channel forming member having a second surface that is a surface facing the substrate via the intermediate layer, and a first surface that is an opposite surface to the second surface, the first surface being formed with a plurality of ejection ports that eject liquid from the common liquid chamber, the second surface being formed with a plurality of channels that make each of the plurality of ejection ports and the common liquid chamber communicate with each other, and a plurality of substantially parallel beam structures, the plurality of beam structures forming a slit portion therebetween, and the intermediate layer being provided with a plurality of first opening portions that make the common liquid chamber and each of the plurality of channels communicate with each other, and a plurality of second opening portions that make the slit portion and the common liquid chamber communicate with each other.

The present invention also provides a method for manufacturing a printing element comprising:

a step of forming an intermediate layer on a substrate;

a step of arranging a channel mold member on the intermediate layer;

a step of arranging a channel forming member on the channel mold member;

a step of forming a plurality of ejection ports that make communication from a surface of the channel forming member to the channel mold member;

an opening forming step of providing an opening portion in the intermediate layer;

a step of forming a common liquid chamber in the substrate so as to reach the intermediate layer;

a step of causing the channel mold member to dissolve; and a structure forming step of forming a structure such that by causing the dissolved channel mold member to flow out to the common liquid chamber through the opening portion of the intermediate layer, a structure having a shape corresponding to the channel mold member is formed in the channel forming member, wherein in the structure forming step, the channel forming member is formed with a plurality of channels that make each of the plurality of ejection ports and the common liquid chamber communicate with each other, a plurality of substantially parallel beam structures, and a slit portion between the plurality of beam structures, and in the opening forming step, the intermediate layer is formed with a plurality of first opening portions that make the common liquid chamber and the plurality of channels communicate with each other, and a second opening portion that make the common liquid chamber and the slit portion communicate with each other.

The present invention can provide a technique for avoiding issues during the manufacture and suppressing a reduction in the strength of an intermediate layer used for a printing element of a liquid printing apparatus.

Further features of the present invention will become apparent from the following description of exemplary embodiments with reference to the attached drawings.

DESCRIPTION OF THE EMBODIMENTS

Preferred embodiments of this invention will be hereinafter illustratively described in detail with reference to the drawings. It should be noted that, unless otherwise specified, the sizes, materials, shapes, and relative arrangement or the like of constituent components described in the embodiments are not intended to limit the scope of this invention.

Configuration

Figure 1:
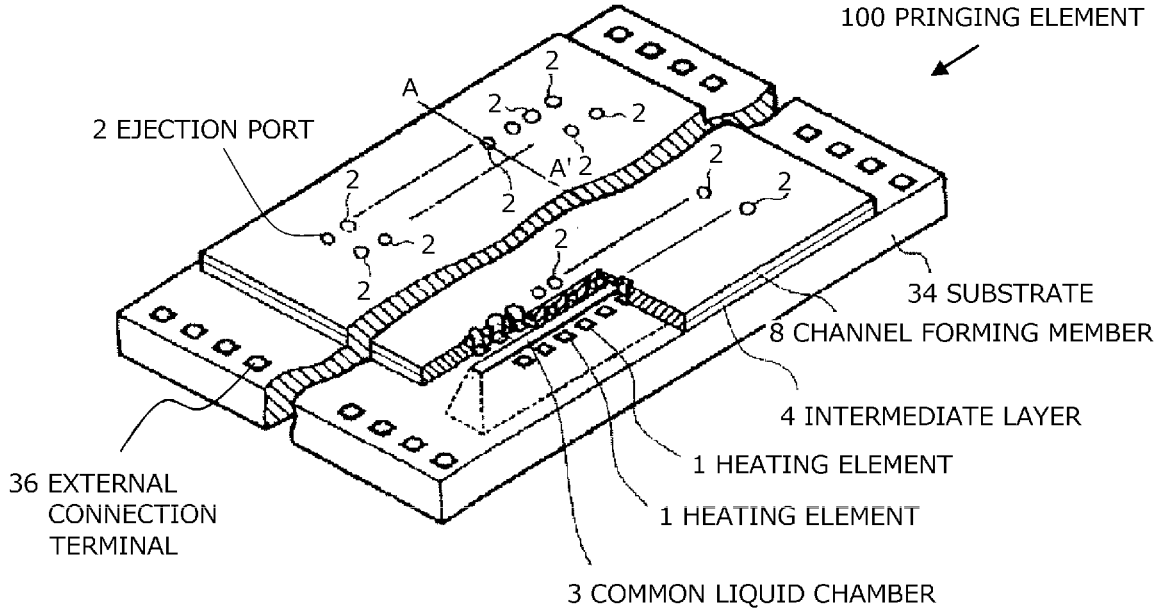
FIG. 1 is a perspective view illustrating a printing element mounted in a liquid printing apparatus.

FIG. 1 is a partially broken perspective view illustrating an overview of a printing element 100 mounted in a liquid printing apparatus. The printing element 100 is a member that is provided to a head mounted on a carriage of a liquid printing apparatus, for example, and ejects a liquid such as ink toward a recording medium.

A printing element here refers to a configuration including ejection ports (nozzles), and liquid chambers and channels in communication therewith. The printing element may also include an ejection energy generating element used for the ejection of ink. In the following, one example of liquid chambers and channels is shown, which is a plurality of bubbling chambers and a plurality of individual channels each corresponding to each of a plurality of ejection ports, and a common liquid chamber that communicates with each ejection port and supplies liquid to each ejection port. In the following example, a thermoelectric conversion element and a switching device or the like that supplies power thereto are used as the ejection energy generating element. The present invention is not limited to this example and may include any other elements that can impart kinetic energy to a liquid as required for ejection thereof.

The printing element 100 has a configuration in which a substrate 34, an intermediate layer 4, and a channel forming member 8 are layered. The substrate 34 is provided with an external connection terminal 36 for transmission and reception of data to and from a controller (not shown) of the liquid printing apparatus or an external device (not shown), and for receiving a power supply from a power supply device.

Figure 2:
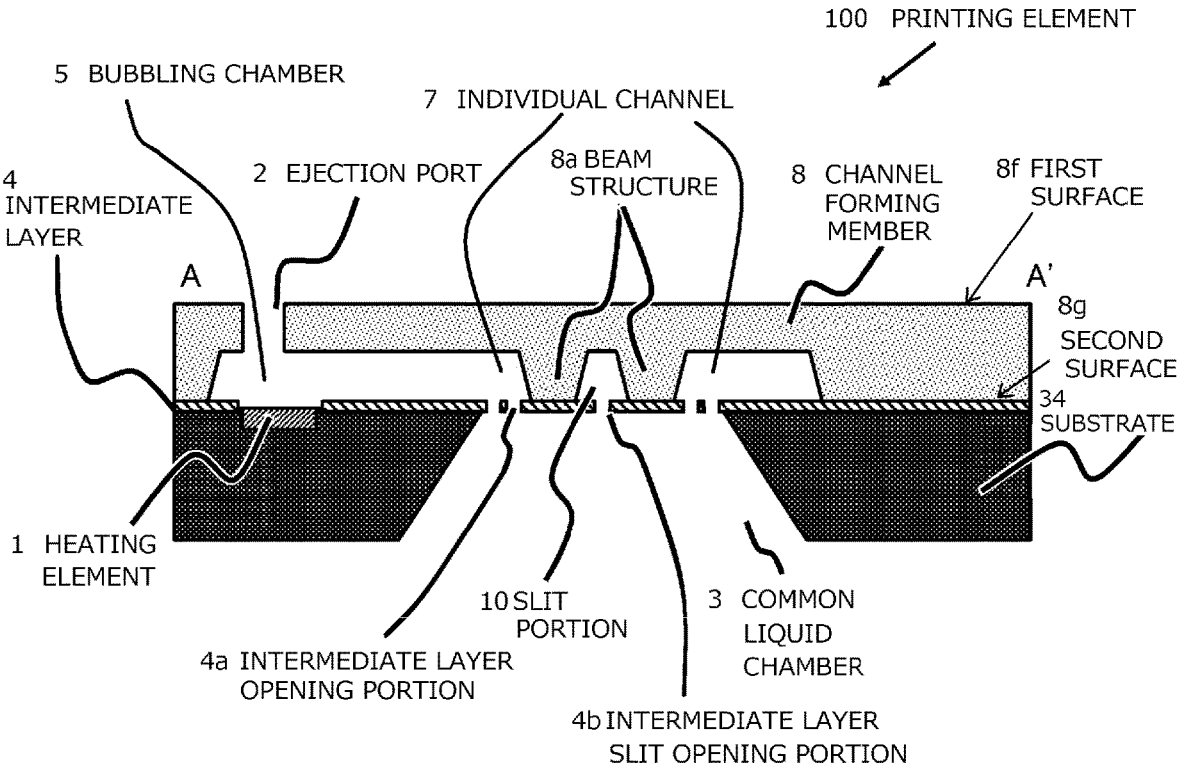
FIG. 2 is an A-A' cross section of FIG. 1.

The components of the printing element 100 are described with reference also to the cross-sectional view of FIG. 2. As illustrated in FIG. 2, a common liquid chamber 3 is formed by the substrate 34 and the intermediate layer 4. Liquid is supplied from the common liquid chamber 3 via individual channels 7 that communicate therewith via intermediate layer opening portions 4*a* to each of the bubbling chambers 5. In this example, the bubbling chambers 5 are provided so as to each correspond to one of heating elements 1 arrayed with a predetermined pitch, and ejection ports 2 are provided so as to each correspond to one of the bubbling chambers 5. Upon application of an electrical signal from the controller to the heating elements 1 with the bubbling chambers 5 filled with liquid, the liquid inside the bubbling chambers 5 around the heating elements 1 is heated instantaneously. As a result, the liquid around the heating elements 1 boils and produces bubbles. The pressure of these bubbles imparts kinetic energy to the liquid inside the bubbling chambers 5 so that the liquid is forced out from the ejection ports 2.

The surface of the channel forming member 8, on which the ejection ports 2 are formed, and which will face the recording medium during the operation of the liquid printing apparatus, shall be referred to as a first surface 8*f*, and the surface opposite from the first surface 8*f* and facing the substrate 34 via the intermediate layer 4 shall be referred to as a second surface 8*g*. The bubbling chambers 5, individual channels 7, beam structures 8*a*, and a slit portion 10 are provided on the second surface 8*g*.

The intermediate layer 4 is generally a thin and uniform film formed between the substrate 34 and the channel forming member 8. The presence of the intermediate layer 4 increases the bond between the substrate 34 and the channel forming member 8. The intermediate layer 4 may be made of any materials or by any film forming techniques. Resin may be used, for example.

Figure 3:
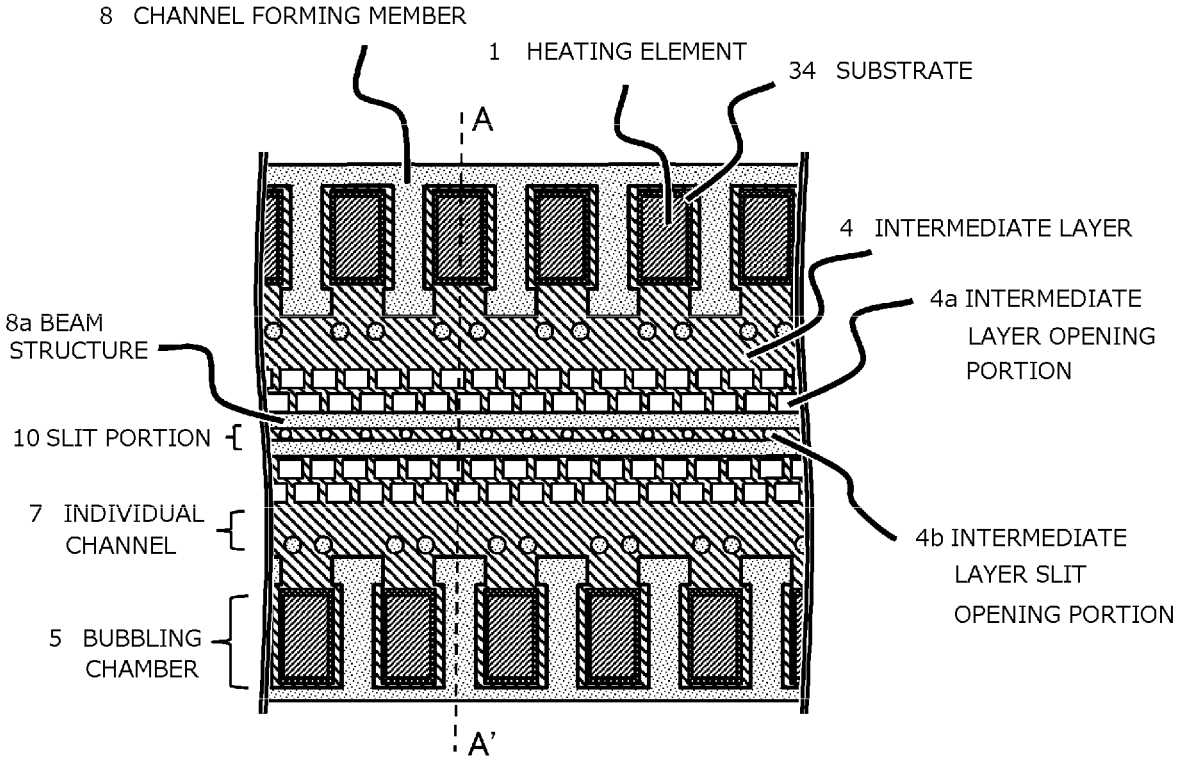
FIG. 3 is a transparent view of one of rows of ejection ports in FIG. 1 observed from a direction perpendicular to the substrate.

FIG. 3 is a transparent view of one of rows of ejection ports 2 in FIG. 1 observed from a direction perpendicular to the substrate 34. In the illustrated example of liquid channels and liquid chambers, the common liquid chamber 3 is a space having a shape defined by the substrate 34 and intermediate layer 4, and having a longitudinal direction (see also FIG. 1). On the other hand, the individual channels 7 and bubbling chambers 5 are a plurality of spaces with their shapes defined by the channel forming member 8 and intermediate layer 4 and provided so as to each correspond to one of the plurality of heating elements 1.

Two approximately parallel beam structures 8*a* are provided along the longitudinal direction of the common liquid chamber 3 for increasing the strength of the printing element. This results in formation of a slit portion 10 between the two beam structures 8*a*. Namely, the slit portion 10 is a space surrounded by the beam structures 8*a*, channel forming member 8, and intermediate layer 4. As mentioned above, the presence of the slit portion 10 enables stress dispersion. "Approximately parallel" means substantially parallel except for manufacturing errors or the like. Specifically, if the lines of best fit for randomly selected ten points on each of two beam structures make an angle of not more than one degree, the two beam structures are approximately parallel.

FIG. 3 illustrates an example in which a contamination particle collection filter is formed by the intermediate layer 4. Namely, the intermediate layer 4 is formed with openings having a size that blocks foreign substances (contamination particles) of at least a predetermined size while allowing the flow of liquid to provide the effect of preventing contamination particles from entering each bubbling chamber 5 from the common liquid chamber 3. Thus, the intermediate layer 4 functions as an intermediate layer filter that collects foreign substances from the liquid. Moreover, this function of the intermediate layer 4 is available without compromising the effect of increasing the bond between the substrate 34 and the channel forming member 8.

In forming this intermediate layer filter, it is preferable to reduce the number of openings as much as possible in portions that do not affect liquid ejection so as to increase the strength. By doing so, issues resulting from insufficient strength (such as expansion and contraction caused by heat and humidity during the manufacturing process, or tear caused by forces applied from flowing liquid during the use of the liquid printing apparatus, for example) can be avoided.

Manufacturing Process

Next, a series of manufacturing process steps (Step 1 to Step 9) are described with reference to FIG. 4A to FIG. 4C. These manufacturing process steps and the order of layering are merely one example. The present invention is not limited to the example and can employ other options as long as a desired printing element is eventually formed.

Figure 4A:
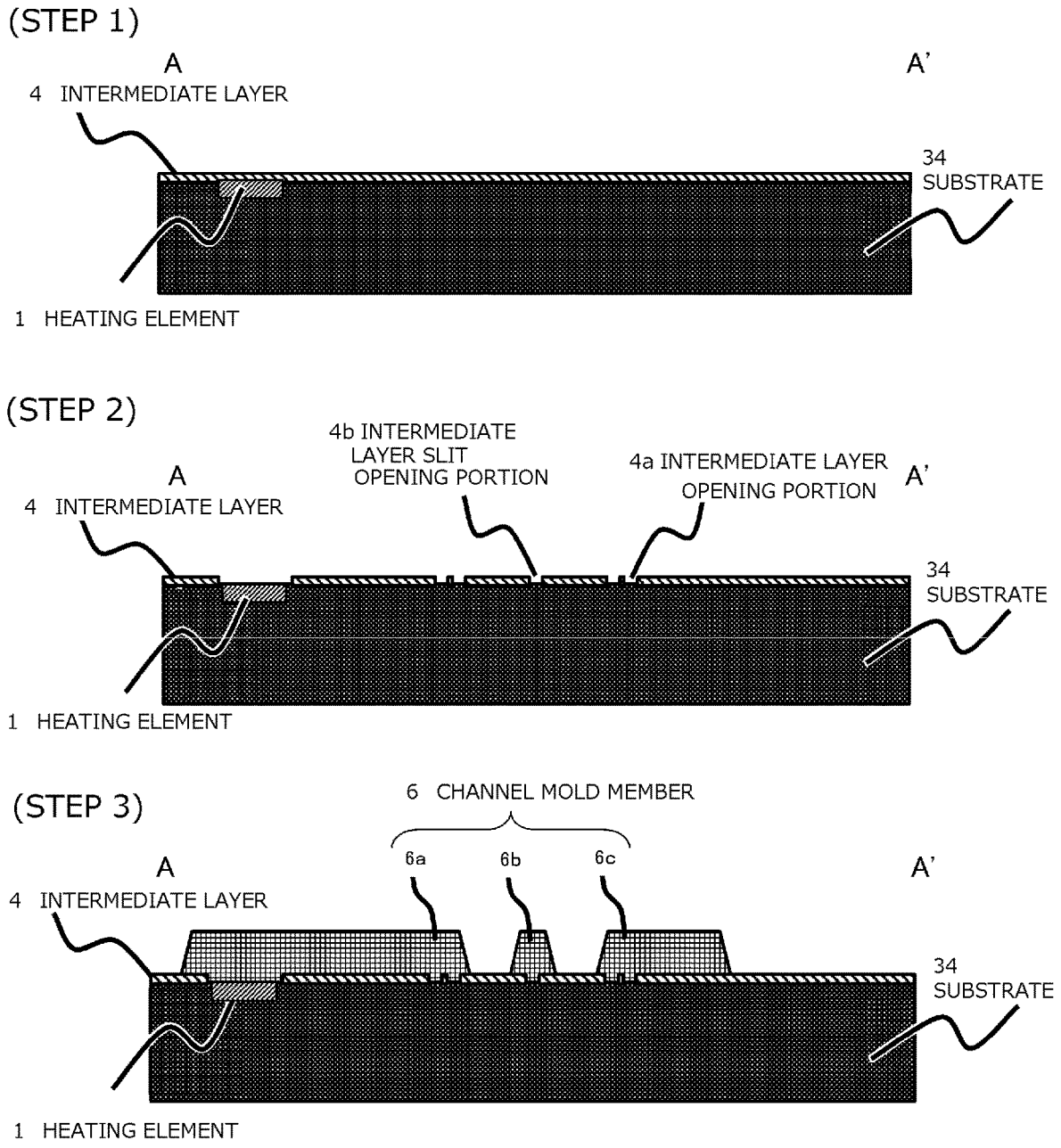
FIG. 4A is a diagram illustrating a flow of a series of manufacturing process steps.
Figure 4B:
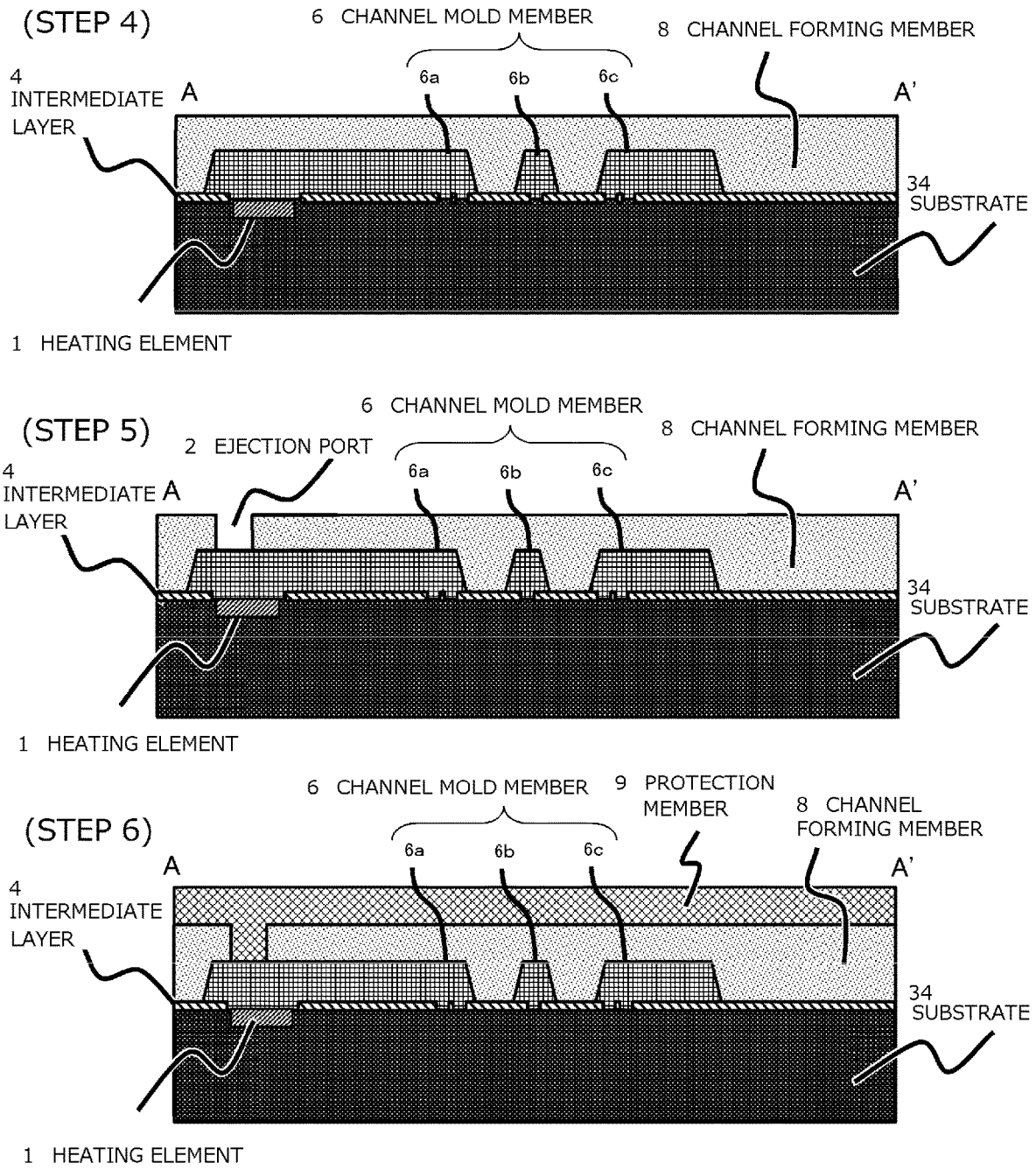
FIG. 4B is a diagram illustrating a successive flow of the series of manufacturing process steps.
Figure 4C:
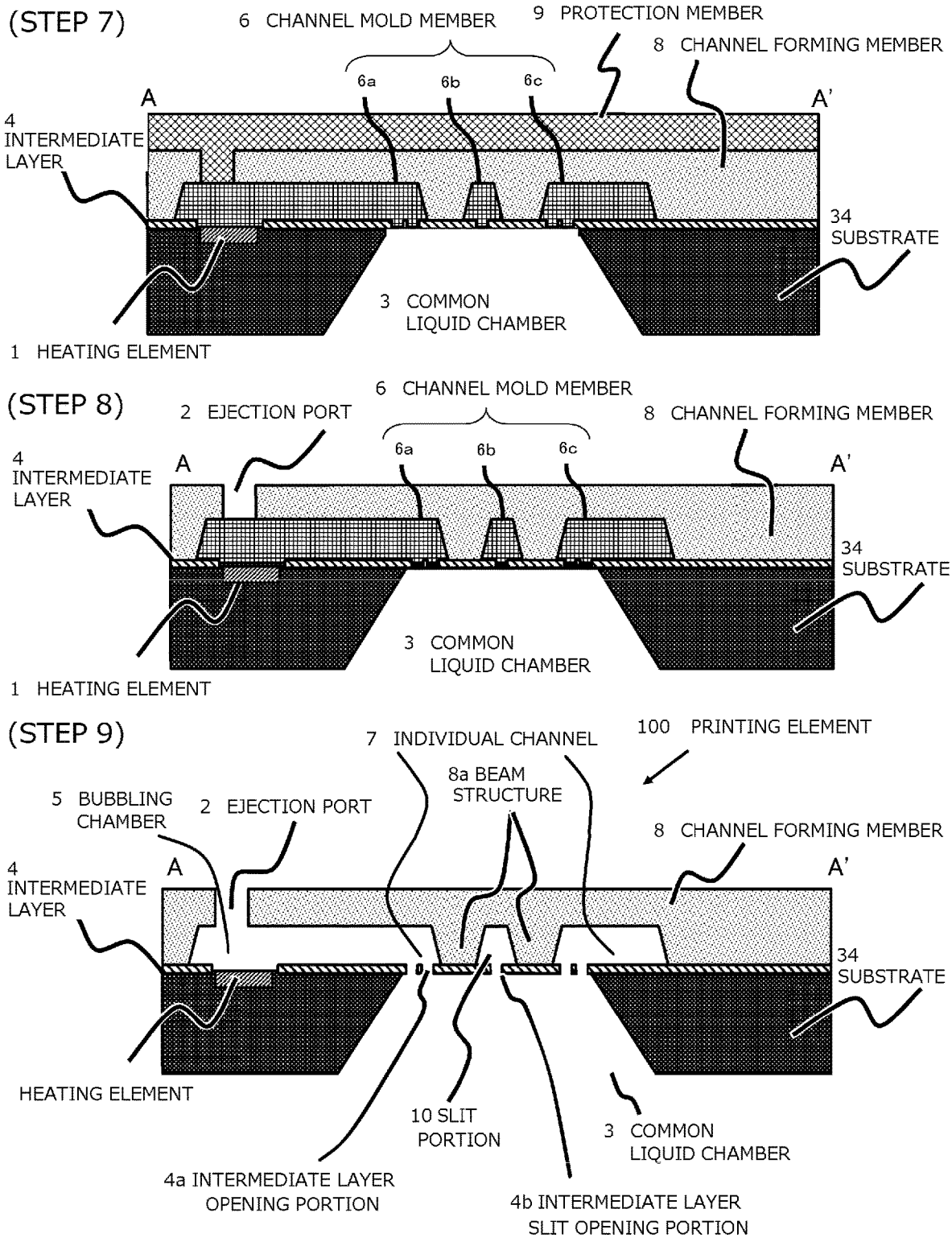
FIG. 4C is a diagram illustrating a successive flow of the series of manufacturing process steps.

First, the intermediate layer 4 is formed on a surface of the substrate 34 as shown in FIG. 4A (Step 1). For the substrate 34, for example, one that includes heating elements 1 and wirings (not shown) formed on a base body made of silicon or the like by semiconductor device fabrication techniques may be used. The intermediate layer 4 may be formed by coating the substrate with a photosensitive material, for example.

Next, opening portions (intermediate layer opening portions 4*a*, or "first opening portions", and intermediate layer slit opening portions 4*b*, or "second opening portions") are formed in the intermediate layer 4 as shown in FIG. 4A (Step 2). In the case where a photosensitive material is used for the intermediate layer 4, the photosensitive material can be formed into a desired pattern by an exposure device and a photomask. Namely, parts of the intermediate layer 4 irradiated with light from the exposure device cure while parts shielded by the photomask remain unset, so that, by washing away parts left uncured after light irradiation, openings of the desired shape can be formed. The material used for the intermediate layer 4 is not limited to the one mentioned above. A positive-type material may also be used, in which case, parts that are not irradiated with light will cure.

Next, a channel forming mold member (hereinafter referred to as "channel mold member") is positioned on the intermediate layer 4 as shown in FIG. 4A (Step 3). Where channel mold members 6*a* to 6*c* need not be distinguished, they will be referred to collectively as channel mold member 6. Next, a channel forming member 8 is set as shown in FIG. 4B (Step 4). For the channel forming member 8, for example, a resin having resistance to the solvent used for dissolution of the channel mold member 6 can be used. Next, ejection ports 2 are formed in the channel forming member 8 so as to extend from the upper surface of the channel forming member 8 as far as to the channel mold member 6 as shown in FIG. 4B (Step 5).

Successively, the common liquid chamber 3 is formed in the substrate 34. First, as shown in FIG. 4B (Step 6), the (surface of) channel forming member 8 is covered by a protection member 9 to prevent adverse effects on the surface that includes the ejection ports 2. Next, the common liquid chamber 3 is formed in the substrate 34 so as to extend as far as to the intermediate layer 4 as shown in FIG. 4C (Step 7). Applicable processes for forming the common liquid chamber 3 can include, but are not limited to, an etching process with preset etching conditions and time. The common liquid chamber 3 is positioned so as to be in communication with the slit portion and individual channels in the finished printing element. Next, the protection member 9 is removed as shown in FIG. 4C (Step 8). Next, the channel mold member 6 is removed as shown in FIG. 4C (Step 9) so that the printing element 100 is complete, with structures such as channels, slit portion, and bubbling chambers being formed (structure forming step). To remove the channel mold member 6, for example, the printing element may be entirely immersed in a solvent with the selectivity for the material of the channel mold member 6.

For the part of the channel mold member 6 corresponding to the slit portion 10, which is surrounded by the intermediate layer 4, channel forming member 8, and beam structures 8*a*, openings need to be initially provided in the intermediate layer 4 to allow the solvent to flow in and out. Otherwise, the solvent cannot flow in, and that part of the channel mold member 6 cannot be removed.

Any remnant of the channel mold member 6 left inside the slit portion 10 may induce manufacturing failures in the successive processes. Possible manufacturing failures include, for example, volume expansion of the channel mold member 6 due to its thermal expansion or vaporization of moisture contained in the channel mold member 6. These failures may lead to damage of the intermediate layer 4, or cracks or large chips of the channel forming member 8 and beam structures 8*a*.

In the illustrated example, to ensure removal of the channel mold member 6, intermediate layer slit opening portions 4*b* are provided in the intermediate layer 4 at the position corresponding to the slit portion 10 (opening forming step). The openings may be formed by any methods. A machine tool may be used, or any other methods may be adopted. The intermediate layer 4 is similarly provided with intermediate layer opening portions 4*a* at the positions corresponding to the individual channels 7. The presence of the intermediate layer slit opening portions 4*b* allows the solvent to enter into the slit portion 10 for the channel mold member 6 to dissolve. When the printing element 100 is pulled out of the solvent after the channel mold member 6 has dissolved, the solvent containing the dissolved channel mold member flows out through the intermediate layer slit opening portions 4*b*, leaving behind the slit portion 10.

Example 1

Next, an example of the printing element 100 formed through the above process steps is described with reference to the drawings. FIG. 3, as mentioned above, is a transparent view illustrating a cross section of one row of ejection ports 2 observed from a direction perpendicular to the substrate 34.

In this example, as illustrated in FIG. 3, openings are provided in the part along the slit portion 10 of the intermediate layer 4 as intermediate layer slit opening portions 4*b*. While the intermediate layer opening portions 4*a* are a structure needed for ejection of liquid, the intermediate layer slit opening portions 4*b* provided in the part along the slit portion 10 do not have a direct bearing on liquid ejection. From the viewpoint of increasing the strength of the intermediate layer filter, it is preferable not to provide openings in the part along the slit portion 10. However, from the aspect of preventing problems during the manufacturing process mentioned before, the intermediate layer slit opening portions 4*b* are needed for obtaining the benefits of both of the intermediate layer filter and the slit structure.

Let us now consider the size of the intermediate layer filter openings in the slit portion, i.e., the intermediate layer slit opening portions 4*b*. For preliminary understanding, the normal intermediate layer opening portions 4*a* are discussed first. Generally, openings in the intermediate layer filter cause resistance to the flows created when the liquid is ejected, and therefore should be as large as possible from the viewpoint of ejection performance. However, too large an opening size would allow contamination particles to pass through, and the smaller opening size is preferable from the viewpoint of contamination particle collection. Openings with a diagonal of about 20 to 40 μm, for example, would achieve both good ejection performance and foreign substance collection, when there are a total of 1200 dpi upper and lower arrays of bubbling chambers. Such sizes are merely one example and may vary depending on the interval of the arrayed bubbling chambers 5, properties of the ejected liquid, and total amount of ejection per unit time, and should be adjusted in accordance with the specifications.

The intermediate layer opening portions 4*a* have a rectangular shape in FIG. 3 and in FIG. 5A to FIG. 5C to be referred to later, because polygonal openings, rather than circular openings, allow the intermediate layer filter to have a smaller area, and can reduce the resistance to the flows of ejected liquid. The openings may of course be circular as long as they do not interfere with the ejection.

On the other hand, the intermediate layer slit opening portions 4*b* in the slit portion do not have a bearing on the ejection performance as mentioned before. Therefore, the openings should be as small as possible, and the number of openings should preferably be reduced from the viewpoint of strength. Regarding the positions of the openings, the pitch of the openings positioned between the individual channels 7 and the common liquid chamber 3, i.e., the pitch of the intermediate layer opening portions 4*a*, is differed from the pitch of the openings in the slit portion, i.e., the intermediate layer slit opening portions 4*b*, in the example of FIG. 3. The stress applied to the intermediate layer filter is thus dispersed, which is advantageous in preventing tear.

In one example where the intermediate layer slit opening portions 4*b* were formed such that about 10 μm circular openings were arranged at 200 dpi, with the slit having a width of about 15 μm, and a height of about 16 μm, channels were formed favorably. On the other hand, when the openings were arranged at a smaller pitch in this example, opening failures occurred. Preferable area and array pitch of the openings are not limited to the example and should preferably be adjusted in accordance with the slit width and the thickness or the like of the channel forming member.

In this example where the printing element has a channel forming member with beam structures for higher strength and a slit for stress dispersion, and is capable of reducing the risk of detachment failure by the good bond of the intermediate layer, the intermediate layer is formed with the openings at the positions and with the size described above. Issues during the manufacture can thereby be avoided and the effect of contamination particle collection can be maintained while the strength of the intermediate layer is retained, as a result of which the degree of design freedom of the printing element is increased.

Example 2

Next, a printing element having a different structure from that of Example 1 is described with reference to FIG. 5A to FIG. 5C. In FIG. 5A, rib structures (8*b* in the drawing) are provided by part of the channel forming member 8. The rib structures 8*b* are a plurality of rib-like structures formed to intersect the beam structures 8*a* (preferably approximately orthogonally), which provide the effect of increasing the strength. Here, the pitch between the intermediate layer slit opening portions 4*b* is set such that the openings are positioned on extension lines of the rib structures 8*b*. The parts on the extension lines of the rib structures 8*b* are configured resistant to stress because of the rib structures, so that the adverse effect of providing the intermediate layer slit opening portions 4*b*, i.e., lowering of strength of the intermediate layer filter, can be reduced. "Approximately orthogonal" means substantially orthogonal except for manufacturing errors or the like. Specifically, if the lines of best fit for randomly selected ten points on the rib structure 8*b* and the beam structure 8*a* make an angle of at least 89 degrees and not more than 91 degrees, the rib structure 8*b* and the beam structure 8*a* are approximately orthogonal.

Note, the positions of the intermediate layer slit opening portions 4*b* need not necessarily completely match the extension lines of the rib structures 8*b*. While the filter tends to be more resistant to stress when the openings are closer to the extension lines of the rib structures 8*b*, the stress mitigation effect can be obtained even when the openings are somewhat spaced from the extension lines. For example, the stress mitigation effect tends to be achieved if the openings are located within a range equivalent of about twice the width of the rib structure, with the extension line of the rib structure being the center. Note, however, the stress mitigation effect would differ in accordance with various dimensional designs such as the thickness of the rib structure, the width of the slit portion, the thickness of the channel forming member, and so on.

As described above, according to this example, the channel forming member has rib structures to increase the strength in parts of the printing element, which also helps increase the strength of the intermediate layer filter. As a result, the strength of the entire printing element can be enhanced.

The essence of Example 2 is the provision of openings on the extension lines of the rib structures 8*b* to prevent reduction of strength of the intermediate layer filter. The positions of the openings should be designed on the basis of a balance between the removability of the channel mold member 6 during the manufacture and the strength of the intermediate layer filter. Other examples of intermediate layer slit opening portions 4*b* positioned differently from FIG. 5A from this perspective are described below.

Figure 5A:
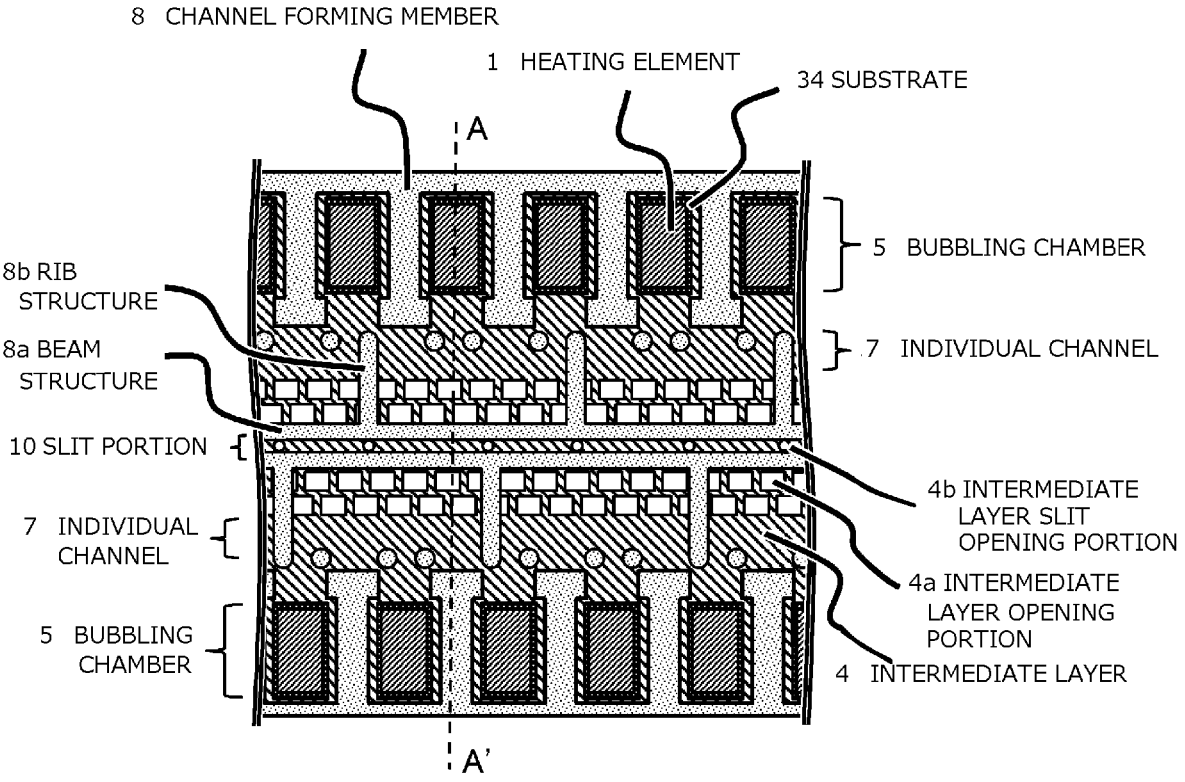
FIG. 5A is a diagram illustrating the relationship between the shape of the channel forming member and openings in Example 2.
Figure 5B:
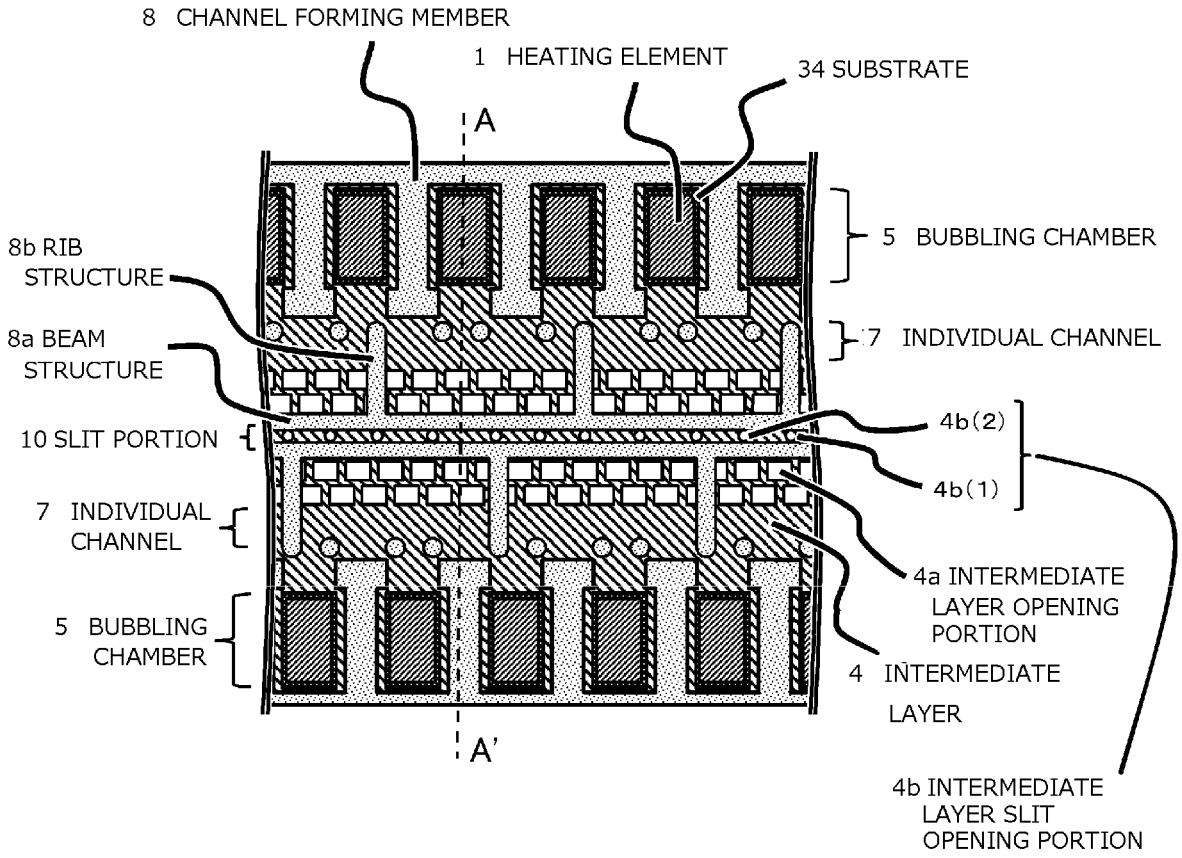
FIG. 5B is another diagram illustrating the relationship between the shape of the channel forming member and openings in Example 2.

In the example shown in FIG. 5B, in addition to intermediate layer slit opening portions 4*b*(1) provided on extension lines of the rib structures 8*b* similarly to FIG. 5A, intermediate layer slit opening portions 4*b*(2) are arranged in other places than on the extension lines of the rib structures 8*b*. Namely, a portion of the plurality of intermediate layer slit opening portions 4*b* are each positioned correspondingly on extension lines of the plurality of rib structures 8*b*. In this case, at least the intermediate layer slit opening portions 4*b*(1) provide the effect of increasing the strength, so that the printing element as a whole can be said to have higher strength than before.

Figure 5C:
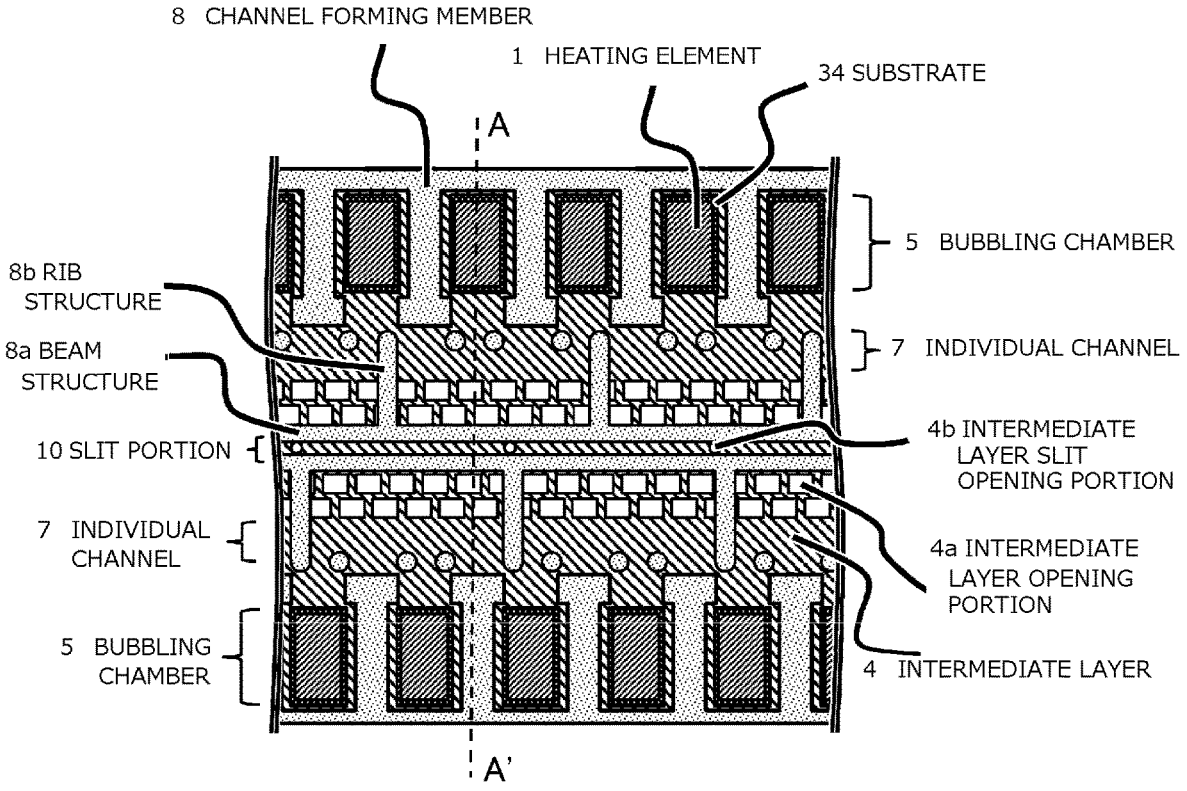
FIG. 5C is another diagram illustrating the relationship between the shape of the channel forming member and openings in Example 2.

Next, in the example shown in FIG. 5C, openings are provided on every other one of the extension lines of the rib structures 8*b*. Depending on the removability of the channel mold member 6 during the manufacture, the openings may be provided each every two or three, or even more rib structures. In the case with FIG. 5C, the smaller the number of openings, the higher the filter strength.

In this example where the channel forming member has rib structures in addition to the beam structures, strength reduction of the intermediate layer filter can be prevented by providing openings on the extension lines of the rib structures or within a predetermined range from the extension lines. As with Example 1, the effect of avoiding issues during the manufacture and of collecting contamination particles can be similarly achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-102356, filed Jun. 12, 2020, which is hereby incorporated by reference herein in its entirety.

What is claimed is:

1. A printing element comprising a substrate, an intermediate layer, and a channel forming member, layered in this order, the substrate including a common liquid chamber, the channel forming member having a second surface that is a surface facing the substrate via the intermediate layer, and a first surface that is an opposite surface to the second surface, the first surface being formed with a plurality of ejection ports that eject liquid from the common liquid chamber, the second surface being formed with a plurality of channels that allow each of the plurality of ejection ports and the common liquid chamber to communicate with each other, and a plurality of substantially parallel beam structures, the plurality of beam structures forming a slit portion therebetween, and the intermediate layer being provided with a plurality of first opening portions that allow the common liquid chamber and each of the plurality of channels to communicate with each other, and a plurality of second opening portions that allow the slit portion and the common liquid chamber to communicate with each other, and the plurality of first opening portions have a pitch different from that of the plurality of second opening portions.

2. The printing element according to claim 1, wherein the intermediate layer collects a foreign substance flowing from the common liquid chamber into the plurality of channels by the plurality of first opening portions.

3. A printing element comprising a substrate, an intermediate layer, and a channel forming member, layered in this order, the substrate including a common liquid chamber, the channel forming member having a second surface that is a surface facing the substrate via the intermediate layer, and a first surface that is an opposite surface to the second surface, the first surface being formed with a plurality of ejection ports that eject liquid from the common liquid chamber, the second surface being formed with a plurality of channels that make each of the plurality of ejection ports and the common liquid chamber communicate with each other, and a plurality of substantially parallel beam structures, the plurality of beam structures forming a slit portion therebetween, the intermediate layer being provided with a plurality of first opening portions that make the common liquid chamber and each of the plurality of channels communicate with each other, and a plurality of second opening portions that make the slit portion and the common liquid chamber communicate with each other, and on the second surface of the channel forming member, a plurality of rib structures substantially orthogonal to the plurality of beam structures are formed.

4. The printing element according to claim 3, wherein the plurality of second opening portions in the intermediate layer are each positioned correspondingly on extension lines of the plurality of rib structures.

5. The printing element according to claim 3, wherein a portion of the plurality of second opening portions in the intermediate layer are positioned correspondingly on extension lines of the plurality of rib structures.

6. The printing element according to claim 3, wherein the plurality of second opening portions in the intermediate layer are each positioned correspondingly on extension lines of a portion of the plurality of rib structures.

* * * * *